United States Patent [19]

Vaseen

[11] Patent Number: 4,754,979

[45] Date of Patent: Jul. 5, 1988

[54] POLYGONS GAME

[76] Inventor: Vesper A. Vaseen, 9840 W. 35th Ave., Wheat Ridge, Colo. 80033

[21] Appl. No.: 920,731

[22] Filed: Oct. 20, 1986

[51] Int. Cl.[4] ..... A63F 9/20

[52] U.S. Cl. ..... 273/292; 273/275; 273/294; 434/96; 434/160; 434/278

[58] Field of Search ..... 273/275, 292, 271, 236, 273/293, 294, 295; 434/96, 160, 278, 279

[56] References Cited

U.S. PATENT DOCUMENTS

| | | | |
|---|---|---|---|
| 1,893,944 | 1/1933 | Johnson | 434/96 |
| 3,384,982 | 5/1968 | Herbert et al. | 434/96 |
| 3,695,615 | 10/1972 | Shoptaugh | 273/275 |
| 4,489,513 | 12/1984 | Reiner | 434/96 |

FOREIGN PATENT DOCUMENTS

| | | | |
|---|---|---|---|
| 226471 | 7/1943 | Switzerland | 273/292 |
| 2699 | of 1890 | United Kingdom | 273/271 |

*Primary Examiner*—Anton O. Oechsie

[57] ABSTRACT

This disclosure is a game played with colored chips, which when played on a game board or flat surface, one chip at a time, create for each consecutive of two or more players, with his specific color chips, patterns of number, letters, or geometric designs, depending on the selection of which pattern type, as the game objective at start of game. Values are established for each pattern which determine the winner as the one who has constructed the most patterns and or their accumulated number of values. The game chips are preferably flat pieces of rigid or semirigid material, having multiple edges, such as squares, hexagons, octagons, etc. Each consecutive play by each player constructs "legs", that is, a group of same color chips in a row, of two or more, the combinations of these rows used to construct the specific pattern selected by the player.

5 Claims, 4 Drawing Sheets

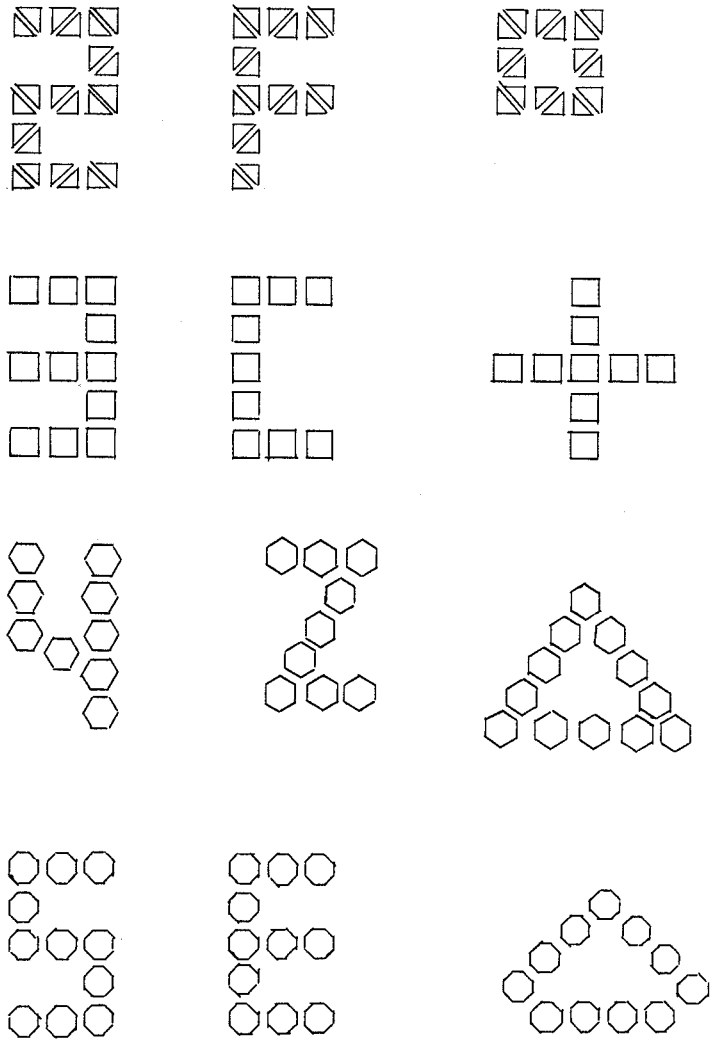
FIG - IV

POLYGONS GAME

HISTORICAL AND PRIOR ART

Most games require some apparatus or equipment. This may be as simple as a pair of dice or a deck of cards, or complicated with complex playing rules and use of many pieces of apparatus.

Some of the most popular games are played on "boards" which are often marked off into patterns are other kinds of divisions.

Probably the oldest of all games is chess, which has been played in China for over 3000 years.

Many of the most popular games invented are "board games".

Historically no board game has been disclosed or played prior to this disclosure which constructs NUMBERS, LETTERS, OR GEOMETRIC SHAPES from groups of polygon chips.

SUMMARY

The POLYGONS games is in fact a multitude of separate games each based on the principal of constructing with specific color chips patterns of NUMBERS, LETTERS, GEOMETRIC SHAPES, or combinations of such. Chips are used, which for each specific type of game have the same number of sides; thus with a great number of practical polygon sided possibilities, along with the numbers, letters, and geometric shapes; the multitude of separate game possibilities. The chips of a specific group of polygons, with each player assigned a different color chip, are played in a consecutive manner around a game board or on a flat surface, with each player constructing "legs" or "rows" of two or more chips in a row, and thus endeavoring to combine his groups of legs into numbers, letters, or geometric shapes, as per the type of game being played. The chips are multisided, flat pieces of material, such as for the types of games as; Triangular, Square, Pentagonal, Hexagonal, Septagonal, Octagonal, and etc. The usual game would have the same number of players as there are sides to the chips, such as with square chips, four players, each player with a different color chip. The game can be played with any number of players, as long as they each have a different color chip. The completed game produces a group of various colored patterns which when each color of chip represents a specific atom, is thus an "abstraction" of the molecular orientation of the DNA (Deoxyribonucleic acid), or "The Scroll Upon Which Is Written The Pattern Of Life". For example, the arbitary color selection of the following atoms is used:

| | | | |
|---|---|---|---|
| Carbon | Black | Calcium | White |
| Hydrogen | Violet | Sodium/Potassium | Green |
| Oxygen | Red | Phosphorous | Orange |
| Nitrogen | Blue | Zinc | Pink |
| Sulphur | Yellow | Manganese | Brown |

Each player always plays from the end of one of his own legs, or partially completed leg, unless he has completed a full pattern, then he may play from any location, such as to "cut off the leg" of an opponent player, thus interrupting the other players being able to complete the pattern and earn points. Point values are arbitrarily assigned to each pattern, with lesser values to easy patterns, average points to moderate patterns, and high values to difficult patterns. The players determine prior to game start as to the type of patterns to build; that is, numbers, letters, and or geometric figures, or combinations thereof. Points are accumulated by each player according to the patterns shapes and the number of completed patterns he has been able to build. The game is over when all chips have been played by all the players. Points are totaled to determine the winner(s).

EXPLANATION OF THE DRAWINGS

FIG. I Illustrates a polygon Game Pattern wherein "legs" or "rows" of 3 and 5 square chips are used to constuct NUMBERS from one (1) to ten (10). The drawing does not intend to restrict the polygons games to legs or rows of threes (3's) and fives (5's); but rather to illustrate the concept on which numbers are constucted, by the players, whenever any quantity in excess of two chips are used to construct legs, numbers are patterned.

FIG. II Illustrates a polygon Game Pattern wherein "legs" or "rows" of (3) three and (5) five square chips are used, by the players, to construct LETTERS from "A" to "Z". The drawing is not intended to restrict the polygons games to legs or rows of three's (3's) and fives (5's); but rather to present the concept in which letters are constructed whenever any quantity of chips in excess of two are used to construct legs, letters are patterned.

Figure 1:
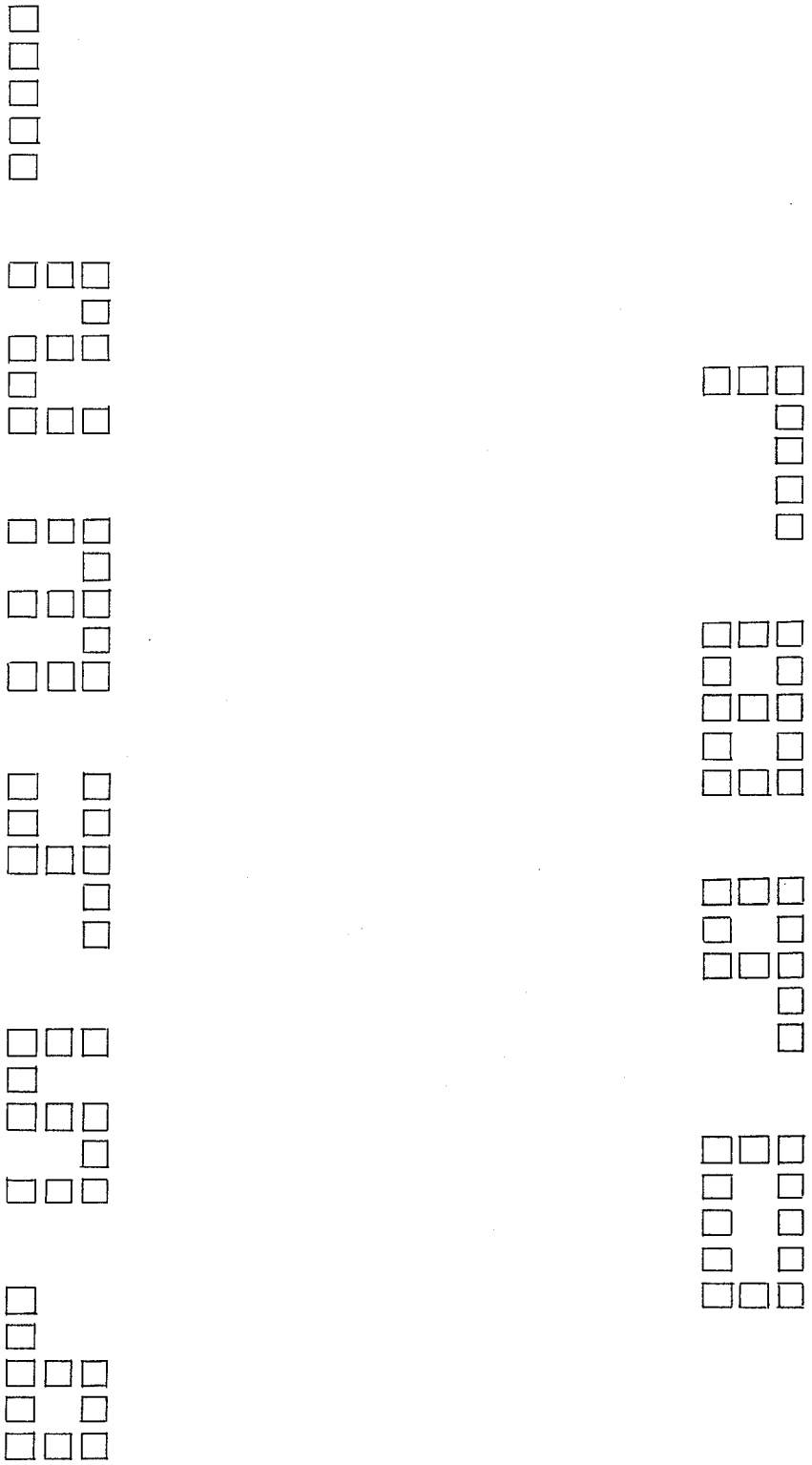
Figure 11:
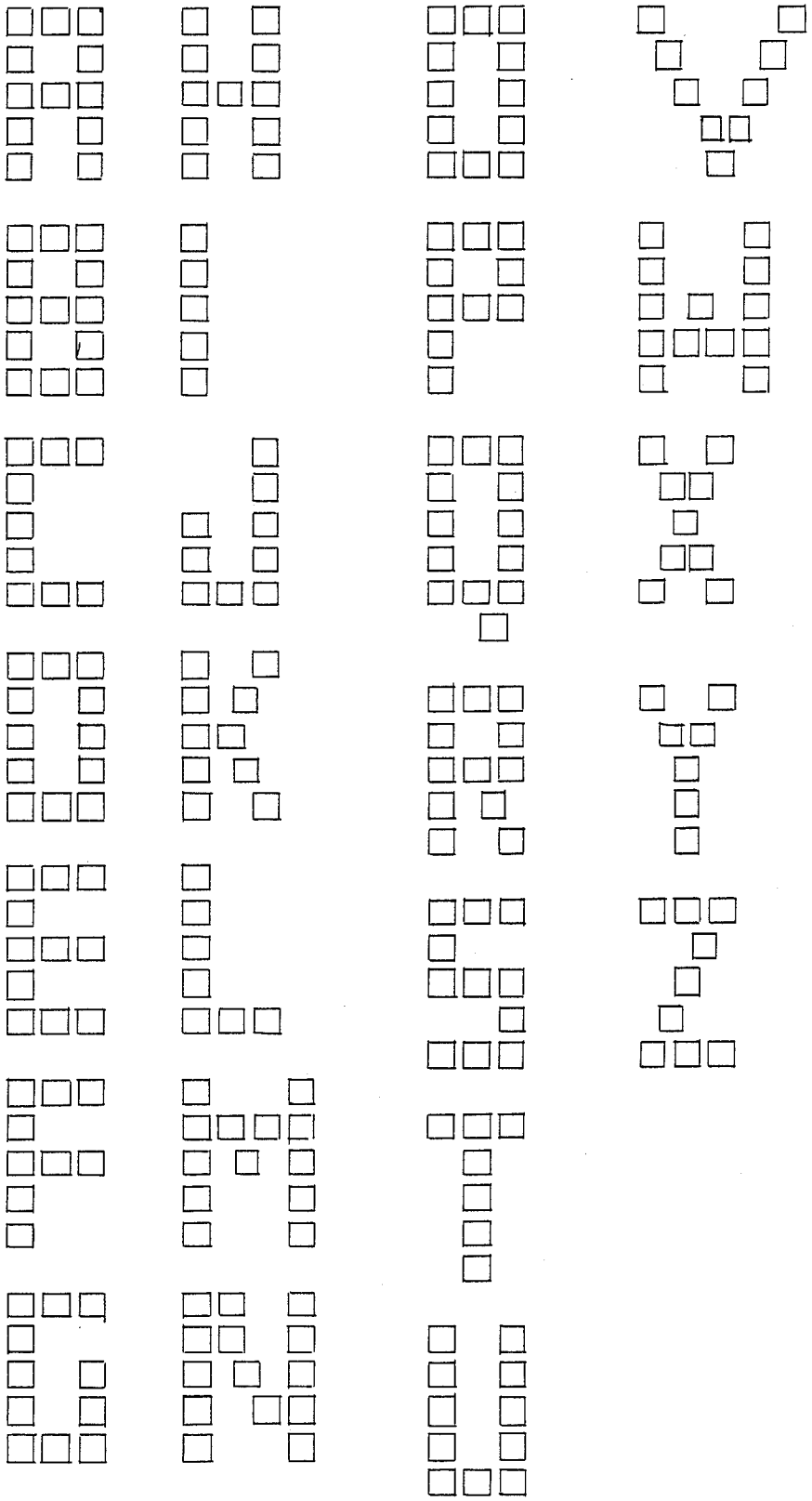
Figure 111:
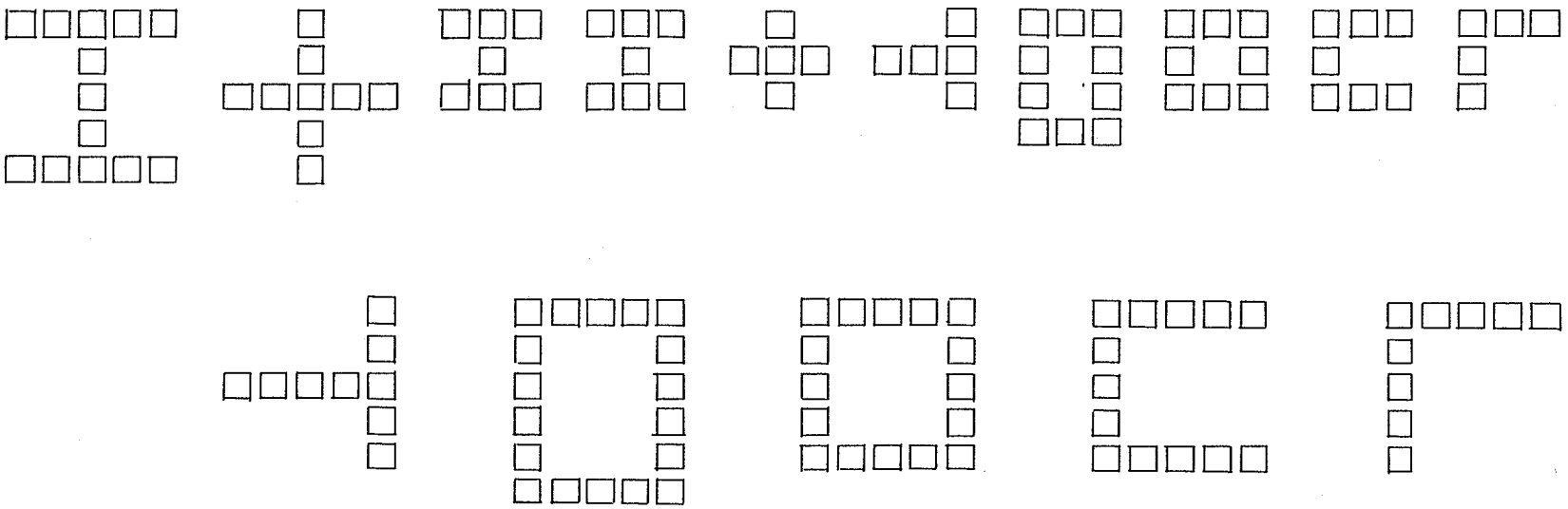

FIG. III Illustrates a polygon game pattern wherein "legs" or rows of 3 and 5 square chips are used, by the players, to construct GEOMETRIC SHAPES. The drawing is not intended to restrict the polygons games to legs or rows of 3 and 5; and as illustrated by legs of 5 and 6 chips; also presents the concept on which geometric shapes are constructed whenever any quantity in excess of two chips are used to construct legs, geometric patterns are constructed.

FIG. IV Illustrates the polygons games as with sample patterns generated by use of triangular, square, hexagonal and octagonal chips. Each type of polygon illustrates one of the many patterns generated by use of the 3 and 6 leg rows to generate as in column 1-NUMBERS, column 2-LETTERS, and column 3-GEOMETRIC DESIGNS. The examples illustrated are illustrative of not only the many numbers, letters, and geometric designs or patterns, the 3 and 6 leg group of chips constructs, but also, the whole realm of numbers, letters, and geometric designs or patterns, or shapes; various combinations of two (2) two legs or more are capable of creating.

PREFERRED EMBODIMENTS

Game Board

The polygons games are played on any flat surface, but preferably on a game board. The game board is sized to retain at completion of a game a chip density of from 10% to 100%, but preferably 40%. The game board is manufactured from any rigid or semi-rigid material, such as wood, metal, glass, paper, ceramic, plastic or other material, preferably of light weight, and which can be folded into two half pieces and stored, when not in use, in a game box. Although the game board is preferably portable, and when not in use stored in a game box, this is not intended to exclude the use of a permanent game board, inlayed, etched, printed, painted, engraved, or otherwise, imposed on any flat surface. The game board, preferably, contains on it's outer edges, examples of the principal NUMBERS, LETTERS, OR GEOMETRIC PATTERNS, in concert with their arbitrarily assigned points used in scoring the game(s). For example FIG. I illustrates one method for the use of square chips polygons organized so as to combine legs of three (3) and rows of five (5) into numbers from one (1) to ten (10). Similarly FIG. II illustrates one method, for example, of the use of square chip polygons organized so as to combine legs of three (3) and rows of five (5) into alphabetical letters from A to Z. Similarly FIG. III illustrates one method, for example, of the use of square chips polygons organized so as to combine legs of three (3) and rows of five (5), or more, as well as legs of five (5) and rows of five (5), or more, into geometric designs or patterns. Preferably, the game board representation of the numbers, letters, and geometric patterns restricts their reproduction along the four outer edges of the game board, to the simpler patterns based on legs of three (3) and rows of five (5). Although any polygon from three sides to an infinite number of sides are able to be designed for use in the polygons games, preferably, the game(s) are restricted to three, four, six and eight sided polygons; that is, triangular, Square, hexagonal, and octagonal. The game board is of any playable dimension, for example, if the game board is a flat floor surface upon which, for example one foot (1') square chips are played by, for example, four players, each with a different color chip(s), with each player assigned 50 chips, then the area upon which the game is played has an area of from 400 sq. ft. to 2000 sq. ft., but preferably at 40% of the area used, of 1000 sq. ft. Similarly for example, if the game board is a flat folded card board-board, or equally acceptable material, upon which are played, by four players, each with a different color chip set and each with 50 chips, each chip being $\frac{5}{8}'' \times \frac{5}{8}'' \times \frac{1}{8}''$, the game board ranges from a square area of 125 sq. in. to 1250 sq. in., but preferably at 40% coverage of 312.50 sq. in. Therefore a game board of $18'' \times 18''$ with an area of 324 sq. in. is preferable. The examples heretofore, are illustrative of the size of game boards as relates to the dimensions of the chips and number of chips used in the polygons games, and are not intended to be restrictive of dimensions or numbers of chips, or type of polygons used for the games.

Chips

The polygons games are played by use of various color chips. The polygons games are in fact a multitude of separate games, all related to a common game concept, that is, representing both the use of different polygon chips, and the objects of the design patterns constructed when playing the chips. The completed game produces a number of group patterns, each of different color, which when each color of chip represents specific atoms, is thus an "abstraction" of the DEOXYRIBONUCLEIC ACID or DNA, known as the "Scroll upon which is written the pattern of life". For example, the arbitrary color assignment to specific atoms is, for example, as follows:

| | | |
|---|---|---|
| Black | Carbon | C |
| Violet | Hydrogen | H |
| Red | Oxygen | O |
| Blue | Nitrogen | N |
| Yellow | Sulphur | S |
| White | Calcium | Ca |
| Green | Sodium/Potassium | Na/K |
| Orange | Phosphorous | P. |

-continued

| | | |
|---|---|---|
| Pink | Zinc | Zn |
| Brown | Manganese | Mn |

By arranging side by side or end to end various chips of the same size and the same shape polygons, legs or rows of chips are constructed which are located so as to construct or build designs and shapes, such as NUMBERS, LETTERS, AND GEOMETRIC PATTERNS. The polygon(s) chip(s) are multisided, flat, relatively thin, pieces of rigid or semi-rigid material, such as paper, plastic, metal, wood, glass, ceramic, and etc., which are coated with color pigment, or preferably made of material which is homogeneously colored. The thickness of the chips is only as required to easily handle the chips; for example, if large chips, such as $12'' \times 12''$ for playing on a yard or court type board, they range from 1/16" to several inches, depending on the material of construction; and for table games, range from 1/32" to the same thickness as the widest dimension across the face of the chip, but preferably $\frac{1}{8}''$. Some polygons are more difficult to use in designing numbers, letters or geometric designs, due to the difficulty in constructing straight legs and rows of relatively few chips, for example legs of three (3); as determined by the angle between the adjacent faces of the edges of the polygons. This is particularly true of five, seven, nine, etc. uneven sided polygons; therefore, preferably the games are designed for use of Triangular (3), Square (4), Hexagonal (6), Octagonal (8) Decagon (10), and Dodecagon (12) polygons. This is not meant to exclude more than twelve (12) sided Dodecagon chips, but preferably, ordinary games are more difficult with more than twelve players or twelve color chips; and thus require larger game boards than the preferred $18'' \times 18''$ board when using $160—\frac{5}{8}'' \times \frac{5}{8}''$ chips.

Game Box

The polygons games, being played with a number of chips, preferably has the parts of the game(s) stored, when not being played with, in a Game Box. Preferably the box has a length, width and depth sufficient to retain the Game Board, Polygon Chips, Score Pads, and Rules & Directions for playing the game(s). For example, the game of SQUARES, that is, played with square chips, for example $\frac{5}{8}'' \times \frac{5}{8}'' \times \frac{1}{8}''$; and designed for four players (four colors); preferably has a length, inside, of $18\frac{1}{4}''$, a width, inside, of $9\frac{1}{4}''$ and a depth of $1\frac{1}{4}''$. The tray of the box, preferably, has along each side four $1'' \times 1'' \times 5''$, inside, open top trays or small boxes; two (2) "up" on each side and two (2) "down" on each side; the four (4) "up" boxes retaining forty (40) chips, a different color in each tray or box; for example 40 red, 40 orange, 40 yellow and 40 blue chips. By way of example this game would enable up to four (4) players, each with a different color chip(s), and each with 40 chips. The tray between the four (4) boxes on each side, preferably contain the three different score pads, that is, NUMBERS, LETTERS and GEOMETRIC PATTERNS. Each score pad, thus being 6" long, 7" wide and up to 1" in depth. The game board, preferably folded to $9'' \times 18'' \times \frac{1}{4}''$ is placed on the top of the open tray of chips, and thus retains them in their respective trays. The box lid, preferably, overlaps the lower tray box sides and thus forms a compact carrying case for the game(s) parts. When the game is designed for more than the four (4) players, then the "down" trays of 1"×1"×5" trays or boxes are also turned "up" and additional color chips, 40 each tray are used to fill all the trays; thus for example 40 red, 40 orange, 40 yellow, 40 blue, 40 green, 40 pink, 40 violet and 40 black. This example is not intended to exclude the retaining of the various chip(s) quantities of various of various colors in bags, sacks, or other retention units thus eliminating the need of tray boxes. The Rules and Directions for playing the polygons games, as per specific game, are preferably printed on the inside of the lid of the game box, but this does not exclude them being furnished as loose documents, or on the bottom, sides, or top of the lid, or otherwise included with the game(s).

Names

The polygon(s) games are designed to specify each game according to the configuration of the polygon chips used to play the game(s); therefore, the names of some of the different polygon games are:

| | |
|---|---|
| TRIANGULUM | Three sides |
| QUADRAGONS/SQUARES | Four sides |
| PENTAGONS | Five sides |
| HEXAGONS | Six sides |
| SEPTIGONS | Seven sides |
| OCTAGONS | Eight sides |
| DECAGONS | Ten sides |
| DODECAGONS | Twelve sides. |

Methods of Play (General)

Polygons games are played with colored chips, which when played on a game board or flat surface, one chip at a time by each player, create for each consecutive player, of two or more persons, with his own specific color chips, PATTERNS of NUMBERS, LETTERS, or GEOMETRIC SHAPES or FIGURES, depending on the selection of which pattern, numbers, letters, or geometric shapes, or combinations thereof, as the game(s) objective at the start of the game. Values for each pattern are arbitrarily established as preferably part of the rules and instructions for playing the game(s). The winner is the player who has constructed the greatest number of score points from his completed patterns.

Score Point Values

Points are established for each completed pattern. Although a great many varied point values can be established as determined by the relative difficulty of constructing the various patterns, preferably, for simplicity of scoring, point values are established as illustrated by the following. Preferably, certain numbers, letters, and geometric shapes, difficult to construct from simple legs and rows of polygon(s) chips, are excluded from use in some of the various polygons games.

| | QUADRAGONS (SQUARES) | HEXAGONS | OCTAGONS |
|---|---|---|---|
| NUMBERS | | | |
| 1 | 10 | — | 10 |
| 2 | 10 | 10 | 10 |
| 3 | 10 | 10 | 10 |
| 4 | 10 | — | 10 |
| 5 | 10 | 10 | 10 |
| 6 | 10 | — | 10 |
| 7 | 5 | — | 5 |
| 8 | 15 | 15 | 15 |
| 9 | 10 | — | 10 |
| 0 | 10 | 10 | 10 |
| GEOMETRIC FIGURES | | | |
| Ell | 5 | — | 5 |
| Tee | 10 | — | 10 |
| U | 10 | — | 10 |
| Square | 10 | — | 10 |
| Cross | 10 | — | 10 |
| H | 10 | — | 10 |
| Rectangle | 10 | — | 10 |
| Triangle | — | — | 10 |
| Diamond | — | 10 | 10 |
| Y | — | — | 10 |
| Star | — | 30 | — |
| LETTERS | | | |
| A | 10 | 10 | 10 |
| B | 15 | — | 15 |
| C | 5 | 10 | 10 |
| D | 10 | — | 10 |
| E | 10 | — | 10 |
| F | 10 | — | 10 |
| G | 5 | — | 5 |
| H | 10 | — | 10 |
| I | 0 | 0 | 0 |
| J | 5 | 10 | 5 |
| K | 10 | — | 10 |
| L | 5 | — | 5 |
| M | 10 | 15 | 10 |
| N | 10 | 10 | 10 |
| O | 10 | 10 | 10 |
| P | 10 | — | 10 |
| Q | 10 | — | 10 |
| R | 10 | — | 10 |
| S | 10 | — | 10 |
| T | 5 | — | 5 |
| U | 10 | — | 10 |
| V | 10 | — | 10 |
| W | 10 | — | 10 |
| X | 10 | — | 10 |
| Y | 5 | — | 5 |
| Z | 10 | 5 | 10 |

Score Pads

Score Pads are not a prerequisite to the polygons games, but are not only convenient, but preferably should be used as the means of tabulating final scores and thus determining the winner(s). For example the following score pads are illustrative of the type of score pads, preferably used.

SCORE PAD: OCTAGONS GAME - NUMBERS

| No. | VALUE | RED | | ORANGE | | YELLOW | | GREEN | | BLUE | | VIOLET | | BLACK | | WHITE | | |
|---|---|---|---|---|---|---|---|---|---|---|---|---|---|---|---|---|---|---|
| | | # | pts | # | pts | # | pts | # | pts | # | pts | # | pts | # | pts | # | pts | |
| 2 | 10 | | | | | | | | | | | | | | | | | |
| 3 | 10 | | | | | | | | | | | | | | | | | |
| 4 | 10 | | | | | | | | | | | | | | | | | |
| 5 | 10 | | | | | | | | | | | | | | | | | |
| 6&9 | 10 | | | | | | | | | | | | | | | | | |
| 8 | 15 | | | | | | | | | | | | | | | | | |
| 0 | 10 | | | | | | | | | | | | | | | | | |
| Totals: | | | | | | | | | | | | | | | | | | |

SCORE PAD: OCTAGONS GAME - GEOMETRIC DESIGNS

| DESIGN | VALUE | RED | | ORANGE | | YELLOW | | GREEN | | BLUE | | VIOLET | | BLACK | | WHITE | | |
|---|---|---|---|---|---|---|---|---|---|---|---|---|---|---|---|---|---|---|
| | | # | pts | # | pts | # | pts | # | pts | # | pts | # | pts | # | pts | # | pts | |
| L | 5 | | | | | | | | | | | | | | | | | |
| T | 10 | | | | | | | | | | | | | | | | | |
| 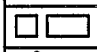 | 10 | | | | | | | | | | | | | | | | | |
| 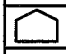 | 10 | | | | | | | | | | | | | | | | | |
| Diamond | 15 | | | | | | | | | | | | | | | | | |
| Triangle | 10 | | | | | | | | | | | | | | | | | |
| Y | 10 | | | | | | | | | | | | | | | | | |
| Totals: | | | | | | | | | | | | | | | | | | |

SCORE PAD: OCTAGONS GAME - LETTERS DESIGNS

| LETTER | VALUE | RED | | ORANGE | | YELLOW | | GREEN | | BLUE | | VIOLET | | BLACK | | WHITE | | |
|---|---|---|---|---|---|---|---|---|---|---|---|---|---|---|---|---|---|---|
| | | # | pts | # | pts | # | pts | # | pts | # | pts | # | pts | # | pts | # | pts | |
| C | 10 | | | | | | | | | | | | | | | | | |
| E | 10 | | | | | | | | | | | | | | | | | |
| F | 10 | | | | | | | | | | | | | | | | | |
| H | 10 | | | | | | | | | | | | | | | | | |
| J | 5 | | | | | | | | | | | | | | | | | |
| L | 5 | | | | | | | | | | | | | | | | | |
| O | 10 | | | | | | | | | | | | | | | | | |
| S | 10 | | | | | | | | | | | | | | | | | |
| T | 5 | | | | | | | | | | | | | | | | | |
| U | 10 | | | | | | | | | | | | | | | | | |
| Totals: | | | | | | | | | | | | | | | | | | |

SCORE PAD: HEXAGONS GAMES GEOMETRIC DESIGNS

| DESIGN | VALUE | RED | | ORANGE | | YELLOW | | GREEN | | BLUE | | VIOLET | | |
|---|---|---|---|---|---|---|---|---|---|---|---|---|---|---|
| | | # | pnts | # | pnts | # | pnts | # | pnts | # | pnts | # | pnts | |
| STAR | 30 | | | | | | | | | | | | | |
| TRIANGLE | 10 | | | | | | | | | | | | | |
| Sm. DIAMOND | 5 | | | | | | | | | | | | | |
| Lrg. Diamond | 10 | | | | | | | | | | | | | |
| | | | | | | | | | | | | | | |
| TOTALS: | | | | | | | | | | | | | | |

SCORE PAD: HEXAGONS GAME - NUMBERS

| NUMBER | VALUE | RED | | ORANGE | | YELLOW | | GREEN | | BLUE | | VIOLET | | |
|---|---|---|---|---|---|---|---|---|---|---|---|---|---|---|
| | | # | pnts | # | pnts | # | pnts | # | pnts | # | pnts | # | pnts | |
| 2 | 10 | | | | | | | | | | | | | |
| 3 | 10 | | | | | | | | | | | | | |
| 5 | 10 | | | | | | | | | | | | | |
| 8 | 15 | | | | | | | | | | | | | |
| 0 | 10 | | | | | | | | | | | | | |
| | | | | | | | | | | | | | | |
| TOTALS: | | | | | | | | | | | | | | |

SCORE PAD: HEXAGONS GAME - NUMBERS

| LETTER | VALUE | RED | | ORANGE | | YELLOW | | GREEN | | BLUE | | VIOLET | | |
|---|---|---|---|---|---|---|---|---|---|---|---|---|---|---|
| | | # | pnts | # | pnts | # | pnts | # | pnts | # | pnts | # | pnts | |
| A | 10 | | | | | | | | | | | | | |
| C | 10 | | | | | | | | | | | | | |
| J | 10 | | | | | | | | | | | | | |
| M | 15 | | | | | | | | | | | | | |
| N | 10 | | | | | | | | | | | | | |
| O | 10 | | | | | | | | | | | | | |
| Z | 5 | | | | | | | | | | | | | |
| | | | | | | | | | | | | | | |
| TOTALS: | | | | | | | | | | | | | | |

SCORE PAD: SQUARES GAME - GEOMETRIC DESIGNS

| Design | Value | RED | | ORANGE | | YELLOW | | BLUE | | |
|---|---|---|---|---|---|---|---|---|---|---|
| | | # | pnts | # | pnts | # | pnts | # | pnts | |
| L | 5 | | | | | | | | | |
| U | 10 | | | | | | | | | |
| Sq. | 10 | | | | | | | | | |
| T | 10 | | | | | | | | | |
| + | 10 | | | | | | | | | |
| H | 10 | | | | | | | | | |
| | | | | | | | | | | |
| Totals | | | | | | | | | | |

-continued

SCORE PAD: SQUARES GAME - NUMBERS

| No. | VALUE | RED | | ORANGE | | YELLOW | | BLUE | | |
|---|---|---|---|---|---|---|---|---|---|---|
| | | # | pnts | # | pnts | # | pnts | # | pnts | |
| 2 | 10 | | | | | | | | | |
| 3 | 10 | | | | | | | | | |
| 4 | 10 | | | | | | | | | |
| 5 | 10 | | | | | | | | | |
| 6 | 10 | | | | | | | | | |
| 7 | 5 | | | | | | | | | |
| 8 | 15 | | | | | | | | | |
| 9 | 10 | | | | | | | | | |
| 0 | 10 | | | | | | | | | |
| | | | | | | | | | | |
| Totals | | | | | | | | | | |

SCORE PAD: SQUARES GAME - LETTERS

| LETTER | VALUE | RED | | ORANGE | | YELLOW | | BLUE | | |
|---|---|---|---|---|---|---|---|---|---|---|
| | | # | pnts | # | pnts | # | pnts | # | pnts | |
| C | 10 | | | | | | | | | |
| E | 10 | | | | | | | | | |
| F | 10 | | | | | | | | | |
| H | 10 | | | | | | | | | |
| J | 5 | | | | | | | | | |
| L | 5 | | | | | | | | | |
| O | 10 | | | | | | | | | |
| S | 10 | | | | | | | | | |
| T | 5 | | | | | | | | | |
| U | 10 | | | | | | | | | |
| | | | | | | | | | | |
| Totals | | | | | | | | | | |

RULES AND INSTRUCTIONS FOR PLAYING THE GAME OF SQUARES

1. The name of the game is SQUARES.

2. The object of the game is for each player, with his color of square chips, representing chemical atoms, attempts to build rectangular designs of NUMBERS, LETTERS, or GEOMETRIC SHAPES, representing molecules. The player with the most accumulated points is the winner.

3. The game is played with two or as many players as there are different color chips.

4. The game is played on a table top or flat surface, on a game board, with each player provided the same number of his color chips.

5. Each player uses only one of his color chips each time it is his turn to play. Players take consequtive turns, moving around the game board clockwise.

6. After a player has completed the construction of three (3) chips, end to end, called a "leg" his attempt to build a design becomes vulnerable. Any player who has completed his last design, and has not started another, can play on any other players chips and thus interfere with the players ability to complete his design. The player who's design was interrupted is then permitted, at his next play, to start a new design on any chip of any color, as long as he plays on the end or either side of the end chip of not less than a leg of three. The player who interrupted the design of the previous player, must play on his interupting chip as the start of his new design.

7. Each player must always play from the end chip, either as a continuation or on either side of his previous uncompleted or completed "leg"; unless his design has been completed, then he may start a new design at any chip of any color.

8. Each players designs must be recognizable and independent of each of his other designs, with not over one chip being common in any two designs.

9. Points are accumulated by each player according to the shape and number of completed designs he has been able to build; such as illustrated on the game board.

10. Game is over when all the chips issued have been played by all the players.

11. Points are totaled to determine the winner.

12. An alternate and optional method of determining the winner is the counting of each chip in only the players completed designs, with the common chip in any two designs counted as two (2).

13. It is optional with the players as to play an "open" game, that is, any player can build any design within the game of NUMBERS, LETTERS, or GEOMETRIC SHAPES; or they can draw cards for their choice of restricted designs assigned only to the specific player.

RULES AND INSTRUCTIONS FOR PLAYING THE GAME OF HEXAGONS

1. The name of the game is HEXAGONS.

2. The object of the game is for each player, with his color of hexagonal chips, representing chemical atoms, attempts to build designs of NUMBERS, LETTERS, OR GEOMETRIC SHAPES, representing molecules. The player with the most accumulated points is the winner.

3. The game is played with two or as many players as there are different color chips.

4. The game is played on a table top or a flat surface, on a game board, with each player provided the same number of his specific color chips.

5. Each player uses only one of his color chips each time it is his turn to play. Players take consecutive turns moving clockwise around the game board.

6. After a player has completed the construction of three (3) chips, end to end, called a "leg" his attempt to build a design becomes vulnerable. Any player who has completed his last design, and has not started another, can play on any other players chips and thus interfere with that players ability to complete his design. The player who's design was interrupted is then permitted, at his next play, to start a new design on any chip of any color, as long as he plays on the end or either side of the end chip of not less than a leg of three. The player who interrupted the design of the previous player, must play on his interupting chip as the start of his new design.

7. Each player must always play from the end chip, either as a continuation or on either side of his previous uncompleted or completed "leg"; unless his design has been completed, then he may start a new design at any chip of any color.

8. Each players designs must be recognizable and independent of each of his other designs, with not over one chip being common in any two designs.

9. Points are accumulated by each player according to the shape and number of completed designs he has been able to build, such as illustrated on the game board.

10. Game is over when all the chips issued have been played by all the players.

11. Points are totaled to determine the winner.

12. An alternate and optional method of determining the winner is the counting of each chip in only the players completed designs, with the common chip in any two designs counted as two (2).

13. It is optional with the players as to play an "open" game, that is, any player can build any design within the game of NUMBERS, LETTERS, or GEOMETRIC SHAPES; or they can draw cards for their choice of restricted designs assigned only to the specific player.

RULES AND INSTRUCTIONS FOR PLAYING THE GAME OF OCTAGONS

1. The name of the game is OCTAGONS.

2. The object of the game is for each player, with his specific color of octagonal chips, representing chemical atoms, attempts to build designs of NUMBERS, LETTERS, or GEOMETRIC SHAPES, representing molecules. The player with the most accumulated points is the winner.

3. The game is played with two or as many players as there are different color chips.

4. The game is played on a table top or flat surface, on a game board, with each player provided the same number of his specific color chips.

5. Each player uses only one of his color chips each time it is his turn to play. Players take consecutive turns moving clockwise around the game board.

6. After a player has completed the construction of three (3) chips, end to end, called a "leg" his attempt to build a design becomes vulnerable. Any player who has completed his last design, and has not started another, can play on any other players chips and thus interfere with that players ability to complete his design. The player who's design was interrupted is then permitted, at his next play, to start a new design on any chip of any color, as long as he plays on the end or either side of the end chip of not less than a leg of three. The player who interrupted the design of the previous player, must play on his interupting chip as the start of his new design.

7. Each player must always play from the end chip, either as a continuation or on either side of his previous uncompleted or completed "leg"; unless his design has been completed, then he may start a new design at any chip of any color.

8. Each players designs must be recognizable and independent of each other of his designs, with not over one (1) chip being common in any two designs.

9. Points are accumulated by each player according to the shape and number of completed designs he has been able to build, such as illustrated on the game board.

10. Game is over when all the chips issued to each player have all been played.

11. Points are totaled to determine the winner.

12. An alternate and optional method of determining the winner is the counting of each chip in only the players completed designs, with the common chip in any two designs counted as two (2).

13. It is optional with the players as to play an "open" game, that is, any player can build any design within the game of NUMBERS, LETTERS, or GEOMETRIC SHAPES; or they can draw cards for their choice of restricted designs assigned only to the specific player.

While the disclosure of the invention of the polygons games has been described in a certain degree of particularity, it is understood that the disclosure has been made by way of examples and that changes in the game board art work, chips colors and sizes, points values assigned various numbers, letters, geometric figures or shapes, numbers of chips which constitute a leg or row, numbers of chips played each play by each player, and other alterations in methods of playing proceedures; may be made without departing from the spirit thereof. Similarly, the number of players is only limited by the number of colors of chips being used when playing the game(s); but preferably, the number of players is equal to the number of sides or edges of the specific polygons used in the game(s); such as three with triangular chios, four with square chips, six with hexagonal chips, eight with octagonal chips, and etc. The number of chips used by each player is preferably less than the number which would exceed, preferably 40% of the game board area. The following table provides a comparison of number of square chips per size of game board. Those familiar with design of games will have no difficulty in designing similar tables for other polygons.

TABLE OF CHIPS DENSITY PER GAME BOARD AREA - PERCENT CHIPS

| | Gross Game Board Area | | |
|---|---|---|---|
| | 18" × 18" | 20" × 20" | 22" × 22" |
| ⅝" × ⅝" Square chips | | | |
| 4 Color at 40 Ea. 160 | 19.31% | 15.64% | 12.93% |
| 4 Color at 50 Ea. 160 | 24.14% | 19.55% | 16.16% |
| ¾" × ¾" Square chips | | | |
| 4 Color at 40 Ea. 160 | 127.80 | 22.62% | 18.61% |
| 4 Color at 50 Ea. 160 | 34.75% | 28.15% | 23.26% |
| ⅞" × ⅞" Square chips | | | |
| 4 Color at 40 Ea. 160 | 37.83% | 30.64% | 25.32% |
| 4 Color at 50 Ea. 160 | 47.13% | 38.30% | 31.65% |
| 1" × 1" Square chips | | | |
| 4 Color at 40 Ea. 160 | 49.38% | 40.00% | 33.07% |
| 4 Color at 50 Ea. 160 | 61.73% | 50.00% | 41.32% |

Recommended maximum chip density of 40%

The games of polygons can be played, as defined in some degree of particulaity, heretofore, with regard to use of rigid boards, rigid or semi-rigid chips, and patio layouts, however this in not meant to exclude the adaption of the game to "video" conversion as played on "computer" instruments, or other electronic devices, such as game boards which are illumniated spots on a panel which when illumniated do so as both the color and shape of specific polygons, as activated by the players selecting switches or other apparatus which will activate the panel illumination.

What is claimed is:

1. A method of playing a pattern forming game comprising the steps of providing a plurality of differently colored polygonally-shaped chips, assigning each of several players a specific color and distributing chips of the assigned colors to the respective players, assigning arbitrary point values to patterns in the form of numbers, letters and/or geometric figures which can be formed by playing the chips in adjacent relationships, the players than taking turns playing their respective chips on a flat surface either in an effort to form various ones of the patterns to which point values have been assigned or, at the player's option if the player has completed a pattern on his or her previous pattern, playing a chip on the surface to block the completion of a pattern by an opponent, the game ending when all of the chips have been played, and the accumulated points being totalled to determine the winner.

2. A method as defined in claim 1 wherein the chips are in the shape of triangles, squares, hexagons or octagons.

3. A method as defined in claim 1 further including the step of providing a game board to serve as the surface on which the clips are played.

4. A method as defined in claim 1 wherein the surface on which the chips are played is a floor.

5. A method as defined in claim 1 wherein the point values are assigned to the patterns in accordance with the degree of difficulty involved in forming the respective patterns.

* * * * *